US006176745B1

(12) United States Patent
Furutani

(10) Patent No.: US 6,176,745 B1
(45) Date of Patent: Jan. 23, 2001

(54) PRESSURE CONTACT CONNECTOR

(75) Inventor: Mitsugu Furutani, Yokkaichi (JP)

(73) Assignee: Sumitomo Wiring Systems, Ltd. (JP)

( * ) Notice: Under 35 U.S.C. 154(b), the term of this patent shall be extended for 0 days.

(21) Appl. No.: 09/277,950

(22) Filed: Mar. 29, 1999

(30) Foreign Application Priority Data

Apr. 8, 1998 (JP) ..... 10-096473

(51) Int. Cl.[7] ..... H01R 13/502; H01R 13/514
(52) U.S. Cl. ..... 439/701; 439/903
(58) Field of Search ..... 439/701, 752, 439/695, 696, 598, 702, 703, 731

(56) References Cited

U.S. PATENT DOCUMENTS 5,122,077 6/1992 Maejima et al. .

5,957,732 * 9/1999 Ito et al. ..... 439/752

* cited by examiner

*Primary Examiner*—Brian Sircus
*Assistant Examiner*—Chandrika Prasad
(74) *Attorney, Agent, or Firm*—Banner & Witcoff, Ltd.

(57) ABSTRACT

A pressure contact connector has inner members which cannot be inserted upside-down, and which has good operability. An inner member includes an upper and lower inner member. A tubular shaped inner housing chamber is provided at the posterior of an outer member, this inner housing chamber being capable of housing the inner member. Position-fixing grooves are formed in a concave manner at the posterior end of the inner housing chamber. When the inner member and outer member are to be attached, position fixing protrusions fit with the position-fixing grooves only when the inner member is in the correct orientation.

15 Claims, 11 Drawing Sheets

9
33
31
5B
5
5A
32A
57
20
56
4
35
34B
34A
27
3
29
46
29A
44
54A
54
56
57
36A
36
34

PRESSURE CONTACT CONNECTOR

TECHNICAL FIELD

The present invention relates to a pressure contact electrical connector.

BACKGROUND TO THE INVENTION

FIG. 14 of this specification shows an electrical connector as shown in JP-2-148583. This connector comprises an outer member 101, and two inner members 102 which are housed within the outer member 101. The anterior portion 104 of the outer member 101 is tubular, and terminal housing chambers 103 are formed on the upper posterior side of portion 104 in order to house pressure contact terminal fittings (not shown). The two inner members 102 can be housed within the portion 104, and fitting holes 106 are formed on side walls in order to support and maintain the inner members 102, by engagement with protrusions 107.

Terminal housing chambers 103, capable of housing terminal fittings, are formed also on the inner members 102. Locking protrusions 108 protrude from the posterior ends of the two side walls of the inner members 102.

In addition to the members 101 and 102, the connector is provided with a locking member 105 which fits with the locking protrusions 108 and supports the connection of the members 101 and 102. Locking holes 109 are formed on this locking member 105, these fitting together with the locking protrusions 108 of the two inner members 102 and the outer member 101.

When the connector, configured as described above, is assembled, the terminal fittings are first housed within each terminal housing chamber 103. Next, the inner members 102 are inserted into the attachment member 104. This causes the fitting holes 106 to fit together with the fitting protrusions 107, which fixes the position of the anterior ends of the inner members 102 in an up-own and anterior-posterior direction. Next, the locking member 105 is attached from above the outer member 101, this causing the locking holes 109 and the locking protrusions 108 to fit together. This strengthens the connecting force between the two members 101 and 102, and fixes the position of the posterior ends of the inner members 102 in an up-down and anterior-posterior direction. Two sets of fitting holes 106 are provided to give temporary and final fitting positions of the inner members 102.

It is possible for the inner members 102 to be inserted in an inverted state. In such a situation, the opening of the terminal housing chambers 103 faces the wrong direction, and the pressure connection of wires to the terminals cannot be performed. Consequently, the connector which has already been assembled must be separated, and the inner members 102 re-inserted correctly. This is a troublesome operation.

The present invention has been developed after taking the above problem into consideration, and aims to present a pressure contact connector in which the inner members cannot be inserted upside-down, and in which operability is improved.

SUMMARY OF THE INVENTION

According to the invention there is provided a pressure contact electrical connector comprising a tubular outer housing, and an inner housing insertable therein, said inner housing comprising an inner body adapted to contain pressure contact terminal fittings and a cover latchable to the inner body, wherein the inner housing has protrusions on opposite sides thereof, and the outer housing has opposite recesses adapted to receive said protrusions in one respective orientation of said outer housing and inner housing only. Such a connector avoids the prior art problems, and ensures that the terminals face in the correct direction for pressure crimping.

Preferably the protrusions protrude to the exterior and are adapted to be gripped or pinched to permit removal of the inner housing.

Most preferably the protrusions also act as a resilient latch for the cover of the inner housing. Separate means of fixing the cover is thus not required, and the moulding can be simplified.

BRIEF DESCRIPTION OF DRAWINGS

Other features of the invention will be apparent from the following description of a preferred embodiment illustrated by way of example only in the accompanying drawings in which.

Figure 1:
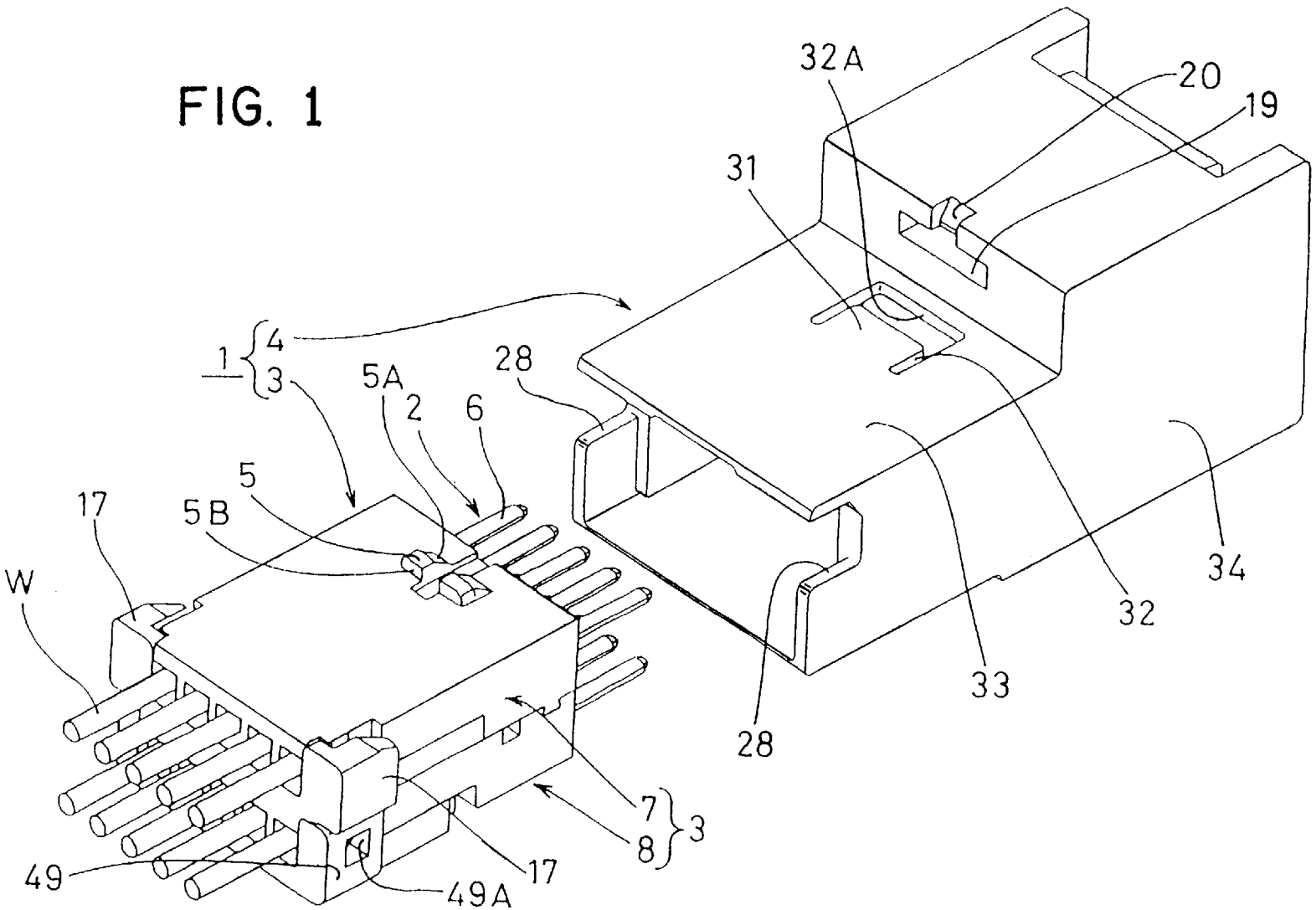
FIG. 1 is a diagonal view of a connector showing an inner member in a joined state prior to being housed within an outer member.

As FIG. 1 shows, a pressure contact connector 1 according to the invention comprises an inner member 3 for housing terminal fittings 2, and an outer member 4 which houses the inner member 3. As will be explained later, the inner member 3 comprises connected upper and lower inner members 7 and 8. In the present embodiment, in order to simplify the explanation, the 'inner member 3' will refer to both the upper and lower inner members 7 and 8 when these are in a connected state. In the following explanation, as shown in FIG. 1, the direction in which stopping protrusions 5 of the inner member 3 protrude will be considered to be the upper side, while the direction in which tabs 6 of the terminal fittings 2 protrude from the inner member 3 will be considered to be the anterior side.

Figure 3:
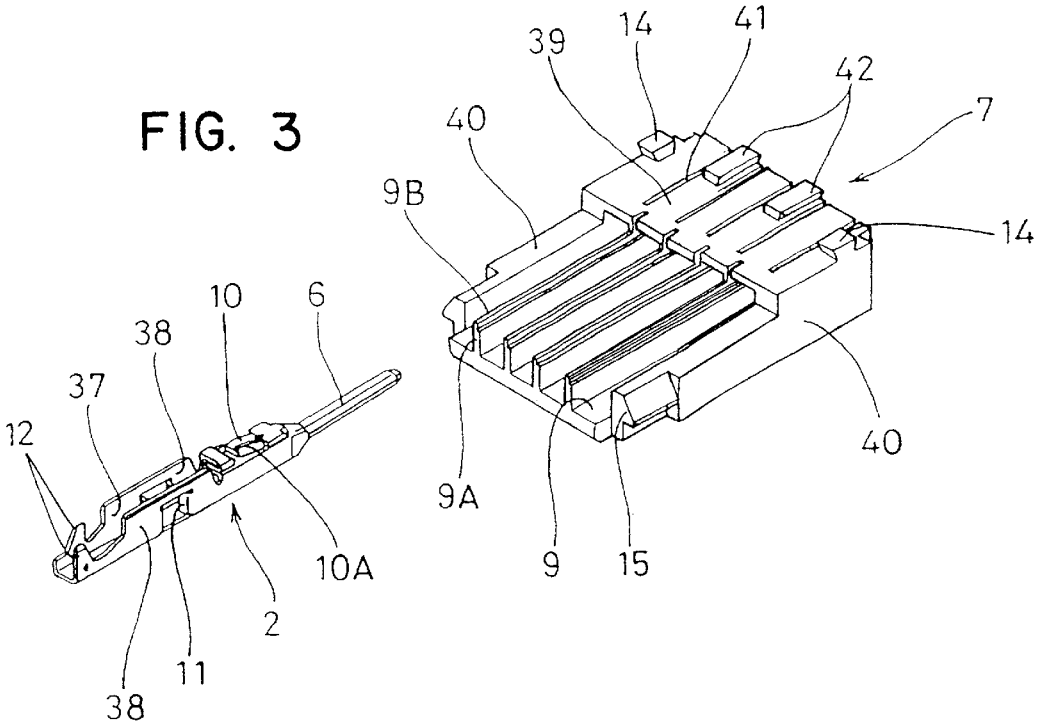
FIG. 3 is a diagonal view showing the upper inner member from the rear side.

As shown in FIG. 3, the terminal fittings 2 are provided on the male side and comprise an electrically conductive metal sheet which has been bent, these joining with corresponding female terminal fittings (not shown). These terminal fittings 2 will be termed pressure contact terminal fittings since they are connected to insulated electric wires W by these being pushed on from above. Tabs 6 protrude from the anterior of the terminal fittings 2, these tabs 6 connecting with the corresponding female terminal fittings. A bendable lance 10 is formed by cutting-away at the posterior of each tab 6. The right edge portion of each lance 10 is folded upwards to form a stopping edge 10A. Furthermore, the left and right side edges of the terminal fitting 2 are folded over to form a pair of side walls 38. A wire insertion groove 37 is formed in the space between the pair of side walls 38, the insulated wire W being inserted into this groove 37 on the side from which the lance 10 was cut away. A pair of left and right barrels 12 protrude at the posterior of the side walls 38, these crimping the wire W. This pair of barrels 12 protrudes from asymmetrical positions relative to one another along the anterior-posterior direction of the terminal fitting 2. A pair of pressure contact blades 11 are cut anteriorly and posteriorly into the sides of the groove 37, these blades 11 being located in the centre of the two side walls 38. These blades 11 are symmetrical on each side. The groove between the tips of the pressure contact blades 11 is slightly smaller in width than the insulation of the wire W. The wire W is pushed in from the open side of the blades 11, which cut into the insulation. The core of the wire W makes contact with the pressure contact blade 11, and the wire W and the terminal fitting 2 come into electrical contact.

Figure 2:
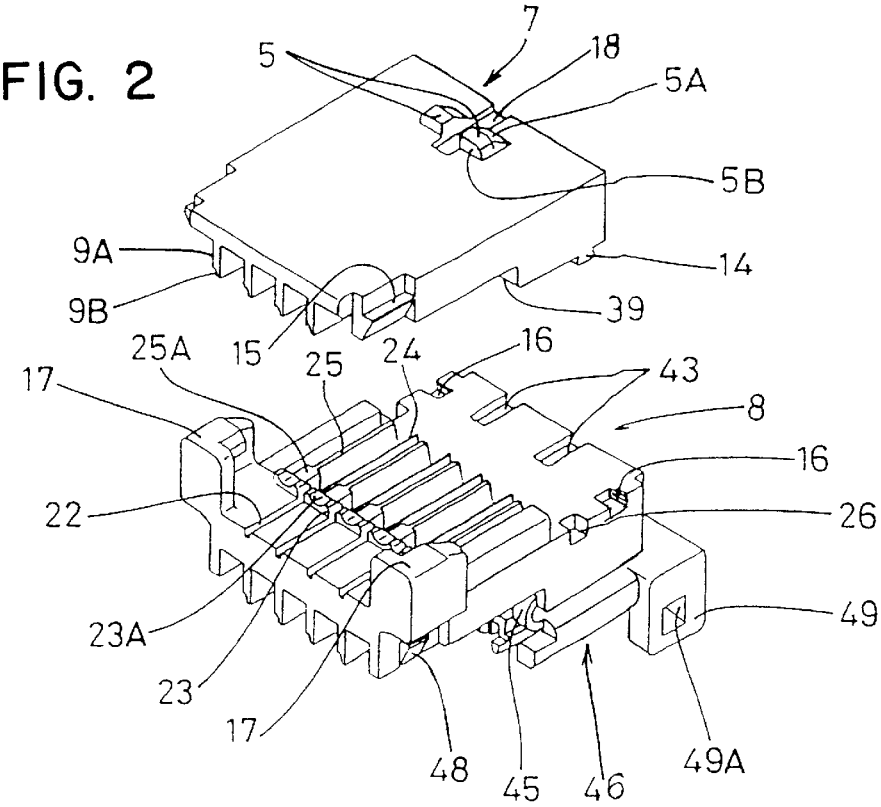
FIG. 2 is a diagonal view showing an upper and a lower inner member in a separated state.

As shown in FIG. 2, the inner member 3 comprises connected upper and lower inner members 7 and 8. The upper and lower inner members 7 and 8 are both of moulded plastic, and the interiors thereof house the terminal fittings 2.

As shown in FIG. 2, a pair of left and right stopping protrusions 5 protrude from the anterior central portion of the upper face of the inner member 7. A jig insertion groove 18, into which a jig (not shown) can be inserted, runs down the centre of these two stopping protrusions 5. This jig insertion groove 18 is provided from the anterior edge of the inner member 7, and passes through the stopping protrusions 5 to a location slightly to the posterior thereof. A jig is inserted into the groove 18 in order to separate the inner member 3 and the outer member 4 after the pressure contact connector 1 has been assembled. Guiding faces 5A are formed on the anterior faces of the stopping protrusions 5, and stopping faces 5B are formed on the posterior faces, these stopping faces 5B being perpendicular with respect to the upper face of the inner member 7.

Terminal housing chambers 9 for housing the terminal fittings 2 are formed on the lower face of the inner member 7 (see FIG. 3). Side walls 40 are formed on the left and right of the inner member 7, and dividing walls 9A are provided at identical distances from one another between these side walls 40. The terminal housing chambers 9 are formed in the divisions between these dividing walls 9A. The anterior end of each terminal housing chamber 9 is provided with a cover 39 which covers the lower face thereof and which, from the centre to the posterior, leaves the pushed-in portion of the wire W open. The cover 39 connects with the two side walls 40. A lance stopping groove 41 is formed in an anterior-posterior direction on the cover 39 at a location corresponding to the right side edge portion of the terminal housing chamber 9, the stopping edge 10A of the terminal fitting 2 fitting into this lance stopping groove 41. Furthermore, as shown in FIG. 3, only the left halves of protruding edges of the dividing walls 9A protrude, these forming step-shaped fitting edges 9B. Dovetailed tenons 14 and 42 protrude from the cover 39, these serving as stopping members which hold the inner members 7 and 8 together. The tenons 42 are a left and right pair located towards the central portion of the cover 39. Seen from the left and right sides of the inner member 7 these tenons are fan-shaped, while seen cross-sectionally from the front they have a trapezoid shape. The tenons 14 are located at the left and right sides of the cover 39. Seen from the anterior and posterior sides of the inner member 7 these tenons are fan-shaped, while seen cross-sectionally from the side they have a trapezoid shape. The engagement of the tenons 14 and 42 is thereby strengthened in either the anterior-posterior direction or the left-right direction, and the inner members 7 and 8 are connected in a balanced manner. The tenons 14 and 42 are engaged respectively by dovetailed grooves 16 and 43 located on the lower inner members 8. Furthermore, stopping claws 15 are formed on the posterior end portion of the left and right side walls 40 by a cut-away portion thereof, the anterior end of each claw 15 being connected with the side wall 40. The claws 15 fit with position-fixing protrusions 17 located on the lower side of the inner member 8.

As shown in FIG. 2, the upper face of the lower inner member 8 is configured such that it will fit with each terminal housing chamber 9 of the upper inner member 7, and will maintain the terminal fittings 2 in a stable manner. The posterior end of the inner member 8 is higher than the central or anterior portions thereof, and dividing-wall housing grooves 22 are formed therein in order to house the fitting edge 9B of the dividing walls 9A. Electric wire supporting members 23 protrude at an anterior location from the grooves 22, these members 23 being provided with pushing faces 23A which correspond to the external diameter of the wires W. The supporting members 23 push down on the wire W behind the posterior edge of the two side walls 38 of the terminal fittings 2. The anterior ends of the supporting members 23 form lower, dividing walls 24 which correspond to the location of the dividing walls 9A. Only half of the edges of the dividing walls 24 protrude, these being on the left in FIG. 2, and forming step-shaped fitting edges 24A. In this manner, the step-shaped fitting edges 9B and 24A are formed in a complementary manner, and fit together with virtually no space between the two when the two dividing walls 9A and 24 are fitted together. An electric wire pressing member 25 protrudes in an anterior-posterior direction from the centre of each dividing wall 24. These pressing members 25 protrude higher than the dividing walls 24, and the posterior portion thereof is wider, forming a wide member 25A. Each pressing member 25 is positioned at the interior of the insertion groove 37, and presses down on the wire W. The wide members 25A are located behind the pressure contact blade 11 located at the posterior of the terminal fitting 2.

The dovetailed grooves 16 and 43 are located at the anterior side of the inner member 8, these fitting with the dovetailed tenons 14 and 42. Jig grooves 26 are formed at a location to the posterior of the dovetailed grooves 16 located on the side edges and allow a jig to be inserted to release the fitting of the inner members 7 and 8. A pair of position-fixing protrusions 17 protrude from both posterior side edges of the upper face of the inner member 8. These protrusions 17, which are at the posterior ends of the inner member 8, can be bent slightly outwards. Connecting grooves 17A are formed on their inner sides, and fit with the claws 15. The width of the protrusions 17 is either the same or slightly less than the outer member 4 (to be described later).

Figure 6:
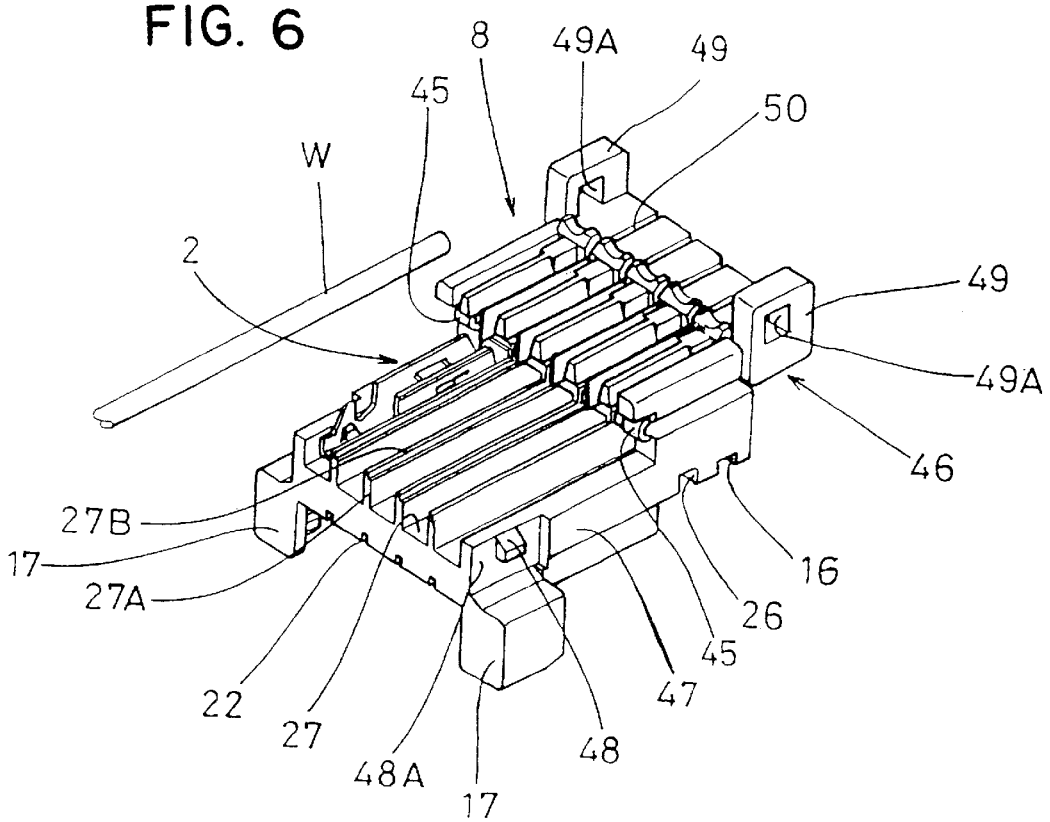
FIG. 6 is a diagonal view showing a terminal fitting about to be attached to the lower inner member.
Figure 5:
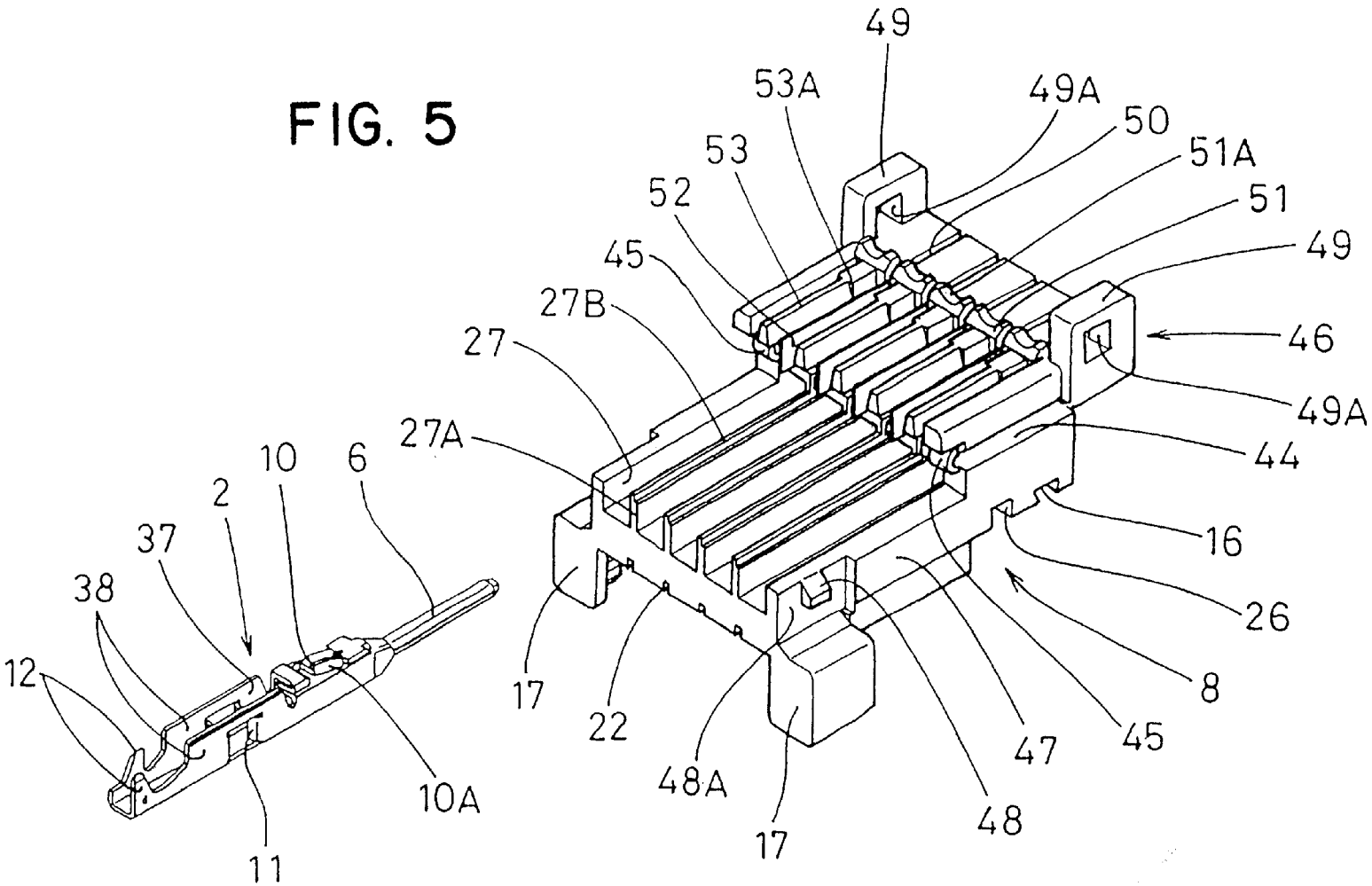
FIG. 5 is a diagonal view showing the lower inner member from the rear side.

As shown in FIGS. 5 and 6, the lower face of the inner member 8 is provided with terminal housing chambers 27 for housing the terminal fittings 2. These terminal housing chambers 27 have approximately the same configuration as the terminal housing chambers 9 of the upper inner member 7, and have a dividing wall 27A, and a fitting edge 27B. A cover 44 is provided on the anterior side of the chambers 27, this cover 44 joining left and right side walls 47 and resulting in the interior of the terminal housing chambers 27 having an angular tubular shape. A lance stopping groove is formed on the cover 44 at a location corresponding to the right side edge portion of each terminal housing chamber 27, these lance stopping grooves being formed in an anterior-posterior direction relative to the inner member 8. (These lance stopping grooves are not shown in FIGS. 5 or 6; however, they are identical with the lance stopping grooves 41 of the inner member 7). Stopping claws 48 are formed on the posterior end portion of the left and right side walls 47, on thin flat faces 48A. These claws 48 fit with claw receiving members 49 that are provided on the cover 44.

A pivotable cover 46 is joined to the posterior end of the cover 44 via a pair of left and right hinges 45. The cover 46 can be pivoted after the terminal fittings 2 have been housed in the terminal housing chambers 27. The rear face of the cover 46 (the face covering the terminal housing chambers 27) has the same configuration as the upper face of the inner member 8. That is, the posterior end of the cover 46 is higher than the central or anterior portions of the cover 46, and dividing-wall housing grooves 50 are formed in this posterior end in order to house the fitting edges 27B located at the tips to the dividing walls 27A. Wire supporting members 51 protrude at a location anterior to the dividing-wall housing grooves 50, and have pushing faces 51A which correspond to the external diameter of the wires W. The supporting members 51 push down on the wire W at a location to the posterior of the posterior edge of the two side walls 38 of the terminal fittings 2. The anterior ends of the supporting members 51 form lower, dividing walls 52 corresponding to the location of the dividing walls 27A. Fitting edges 52A are formed in a step-shape on the tips of the dividing walls 52, these being formed in a complementary manner so as to fit with the fitting edges 27B. A wire pressing member 53 protrudes from the centre of each dividing wall 52, and the posterior portion thereof forms a wide member 53A located to the posterior of the pressure contact blade 11. The pair of claw receiving members 49 protrude from both sides of the posterior portion of the cover 46 and are capable of bending slightly outwards relative to the cover 46, while receiving holes 49A, formed at the centre of the claw receiving members 49, fit with the claws 48.

Before joining the inner members 7 and 8, the terminal fittings 2 are attached to the inner members 7 and 8.

Figure 4:
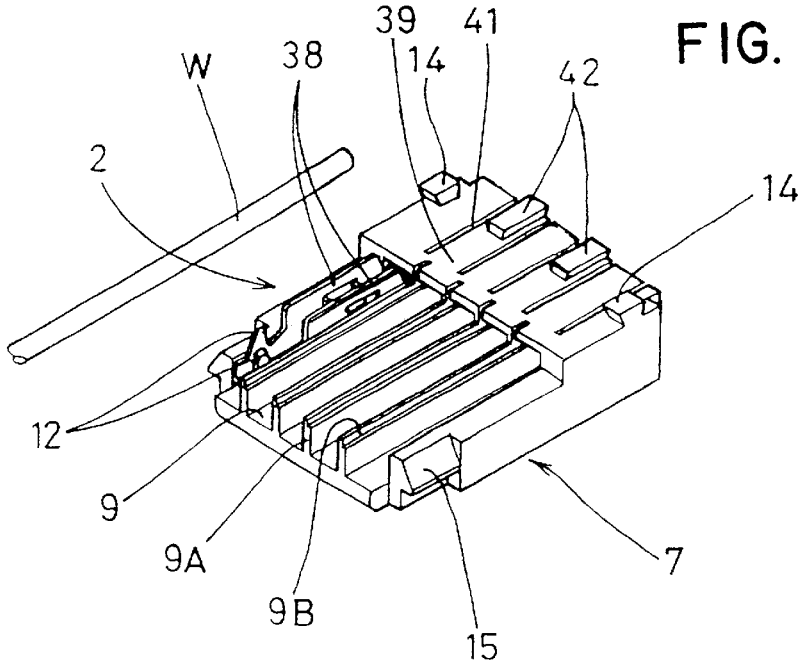
FIG. 4 is a diagonal view showing a terminal fitting about to be attached to the upper inner member.

As shown in FIG. 3, the terminal housing chambers 9 of the inner member 7 face upwards, and the terminal fittings 2 are attached thereto. The terminal fittings 2 are pushed in while the lances 10 are bent downwards to make contact with the lower face of the cover 39. The lances 10 change shape and return to their original position when the terminal fittings 2 are pushed in to the correct position, and the stopping edges 10A of the terminal fitting 2 fit with the posterior edges of the lance stopping grooves 41. At this juncture the electric wire insertion grooves 37 are in a state in which they are open at the top (see FIG. 4). The wire W is inserted from the top of the terminal fittings 2 towards the pressure contact blades 11 which cut the insulation and make electrical contact with the core wire. The barrel 12 is crimped to the wire W, and the terminal fittings 2 is thus completed.

To attach the terminal fittings 2 to the lower inner member 8, the terminal housing chambers 27 face upwards, and the terminal fittings 2 are pushed in to a prescribed position, this causing the stopping edges 10A of the lances 10 to be engaged by the posterior edges of the lance stopping grooves 41, thus retaining the terminal fittings 2 in the terminal housing chambers 27 (see FIG. 6). After this, the pressing operation of the wires W onto the pressure contact blades 11 of the terminal fittings 2 is the same as that described for the inner member 7, and accordingly an explanation thereof is omitted.

Figure 7:
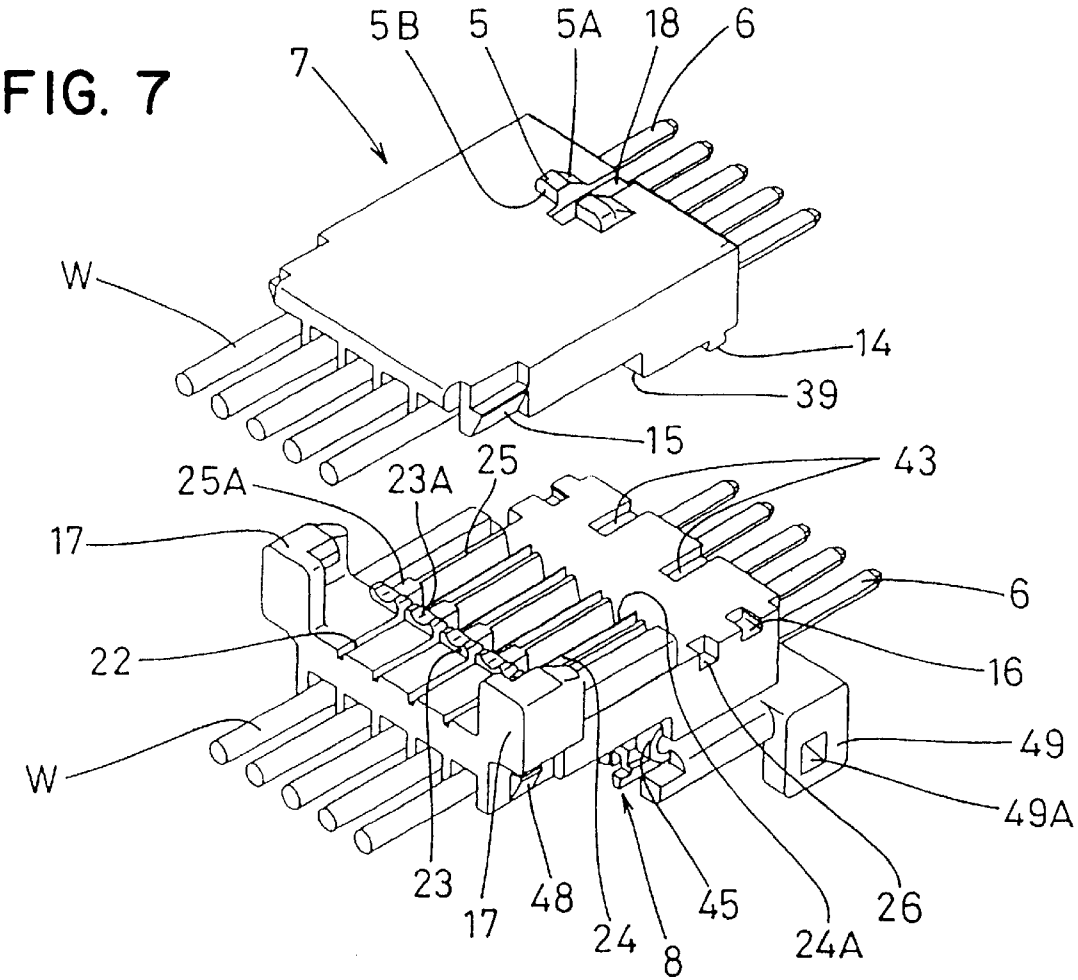
FIG. 7 is a diagonal view showing the inner member with terminal fittings attached and prior to being joined together.
Figure 8:
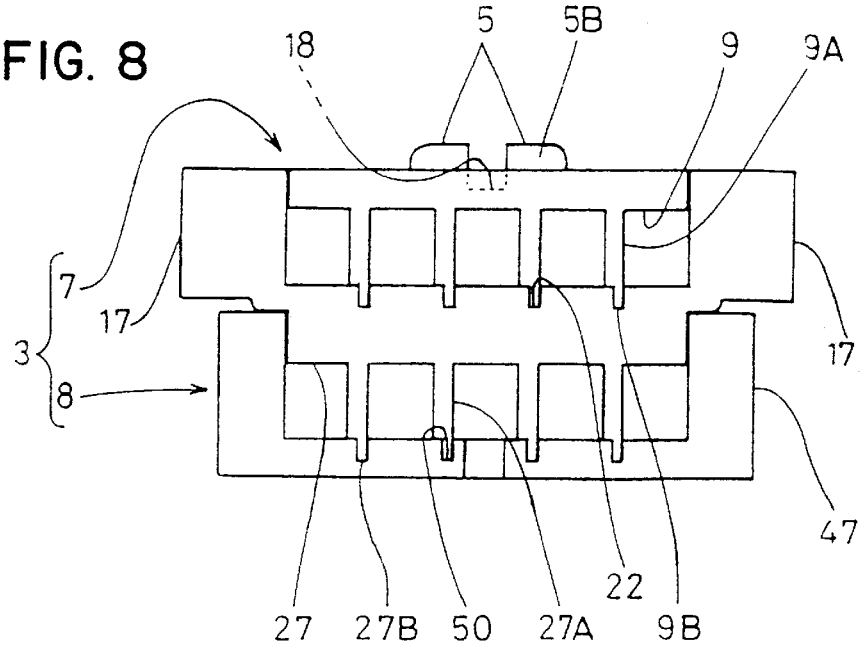
FIG. 8 is a rear side view of the inner member in a joined state.
Figure 9:
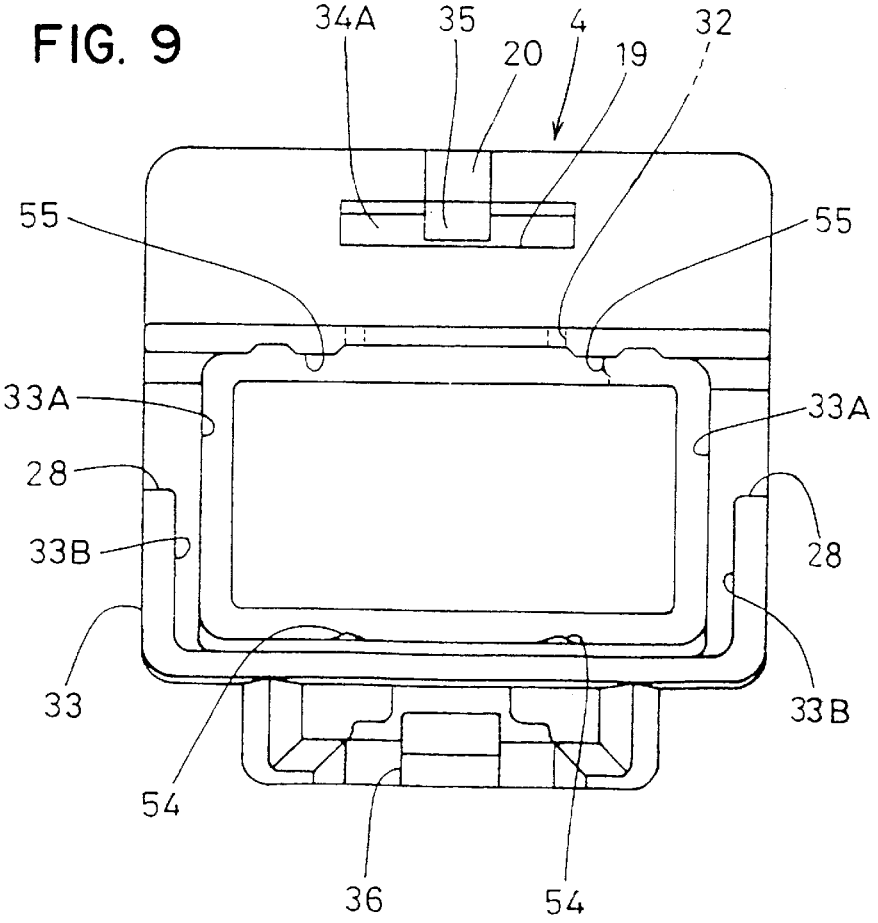
FIG. 9 is a rear side view of the outer member.
Figure 10:
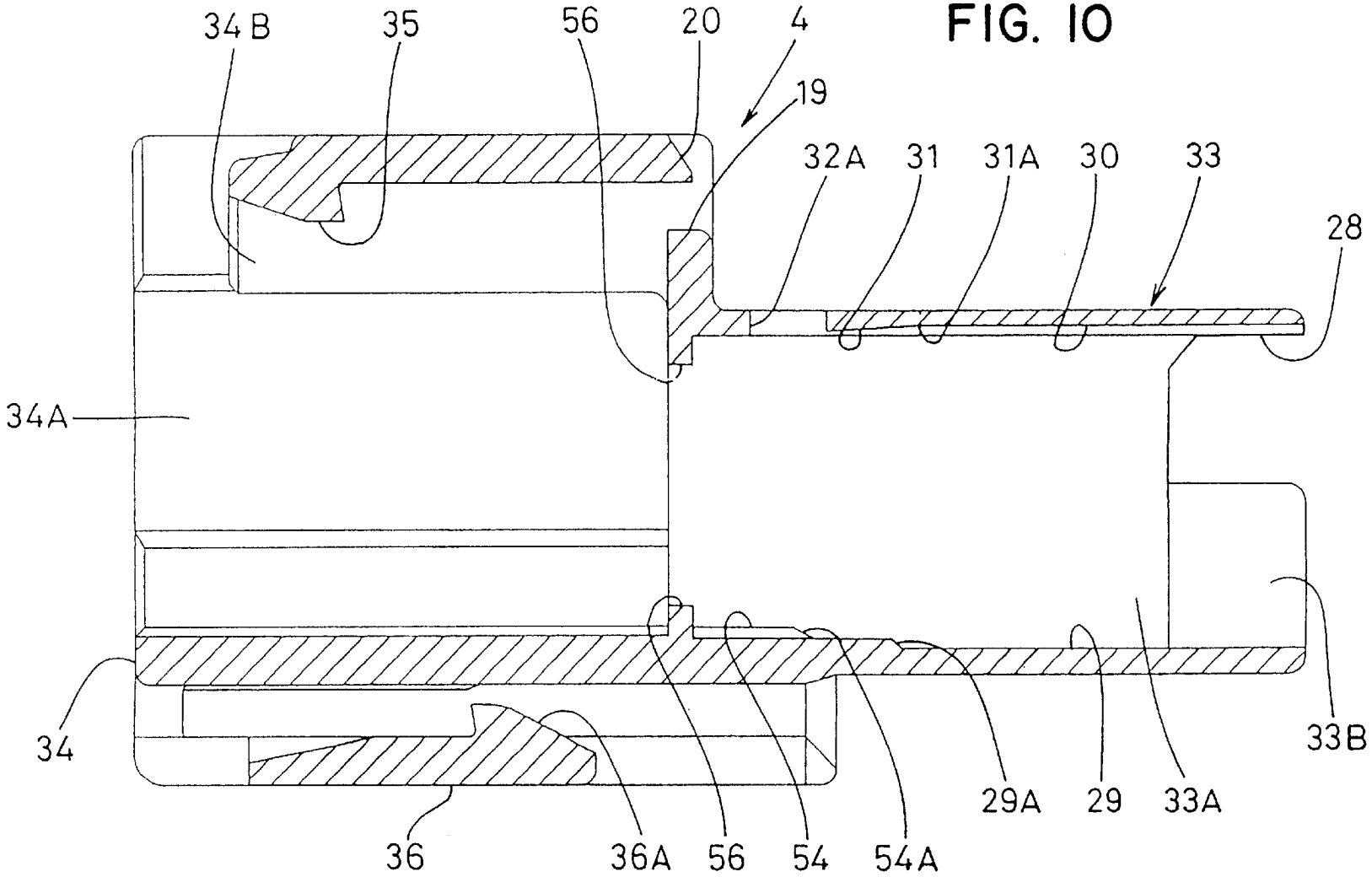
FIG. 10 is a side cross-sectional view of the outer member.
Figure 11:
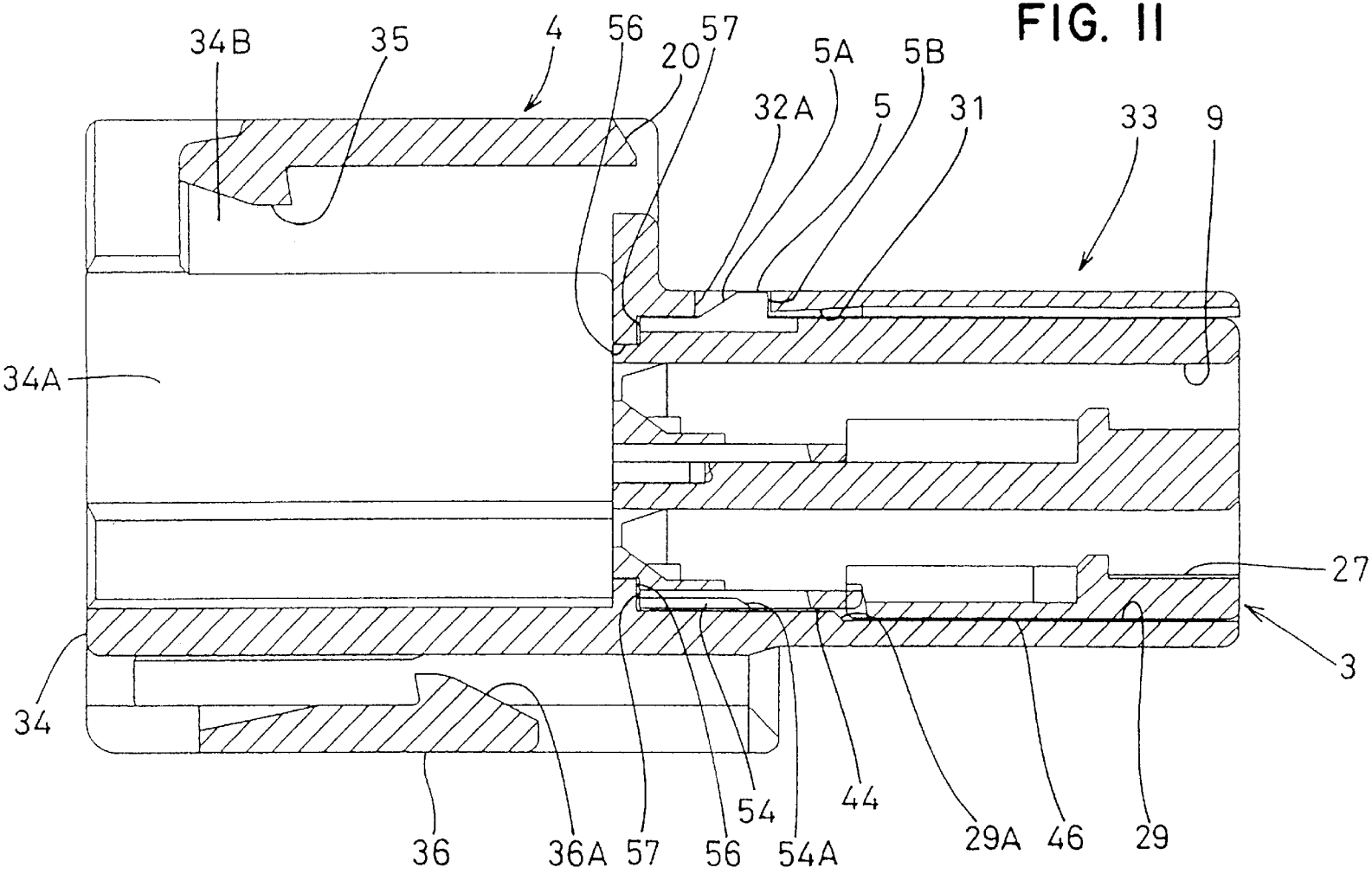
FIG. 11 is a side cross-sectional view of the inner member and the outer member in a joined state (without terminal fittings).
Figure 12:
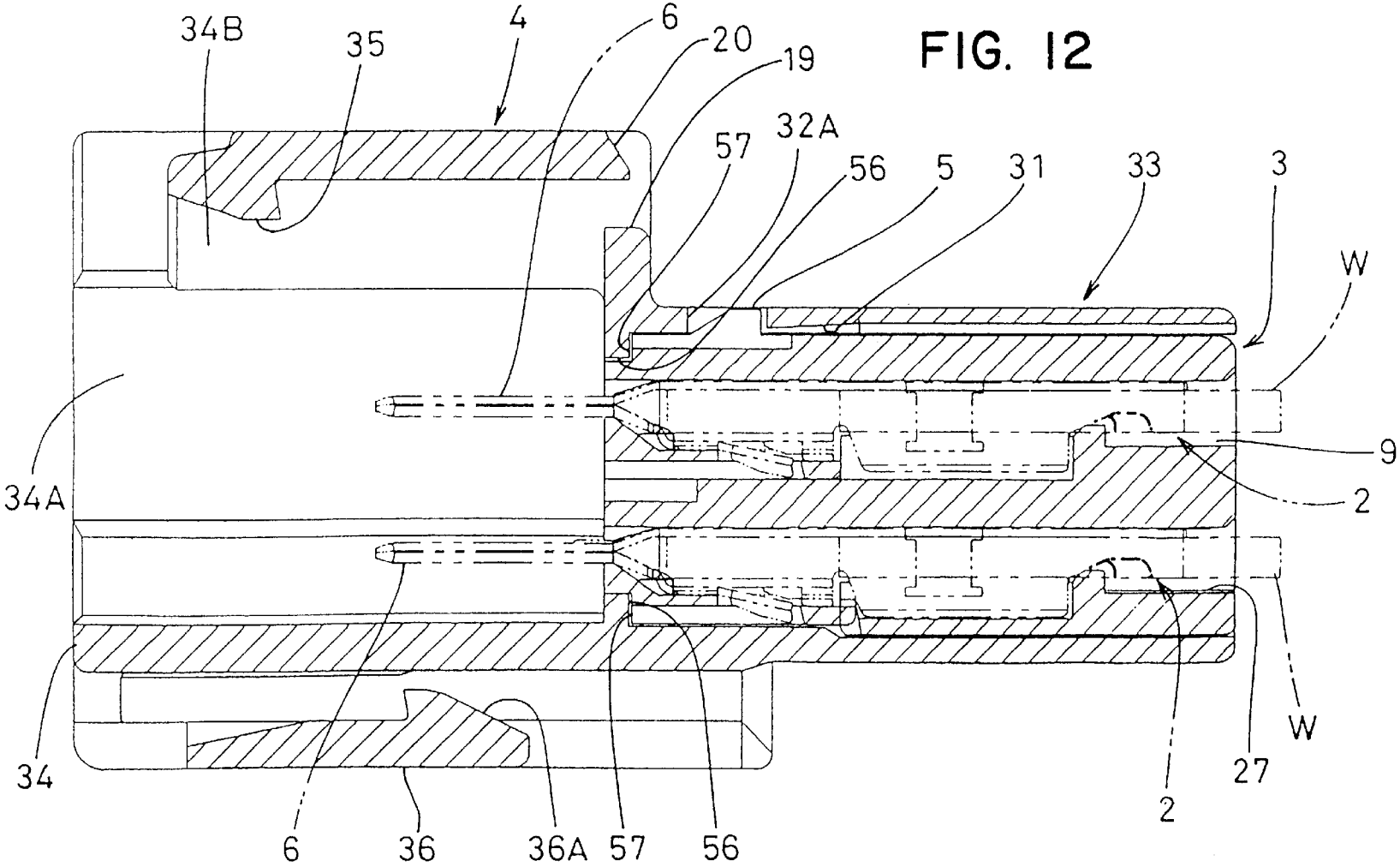
FIG. 12 is a side cross-sectional view of the inner member and the outer member in a joined state.
Figure 13:
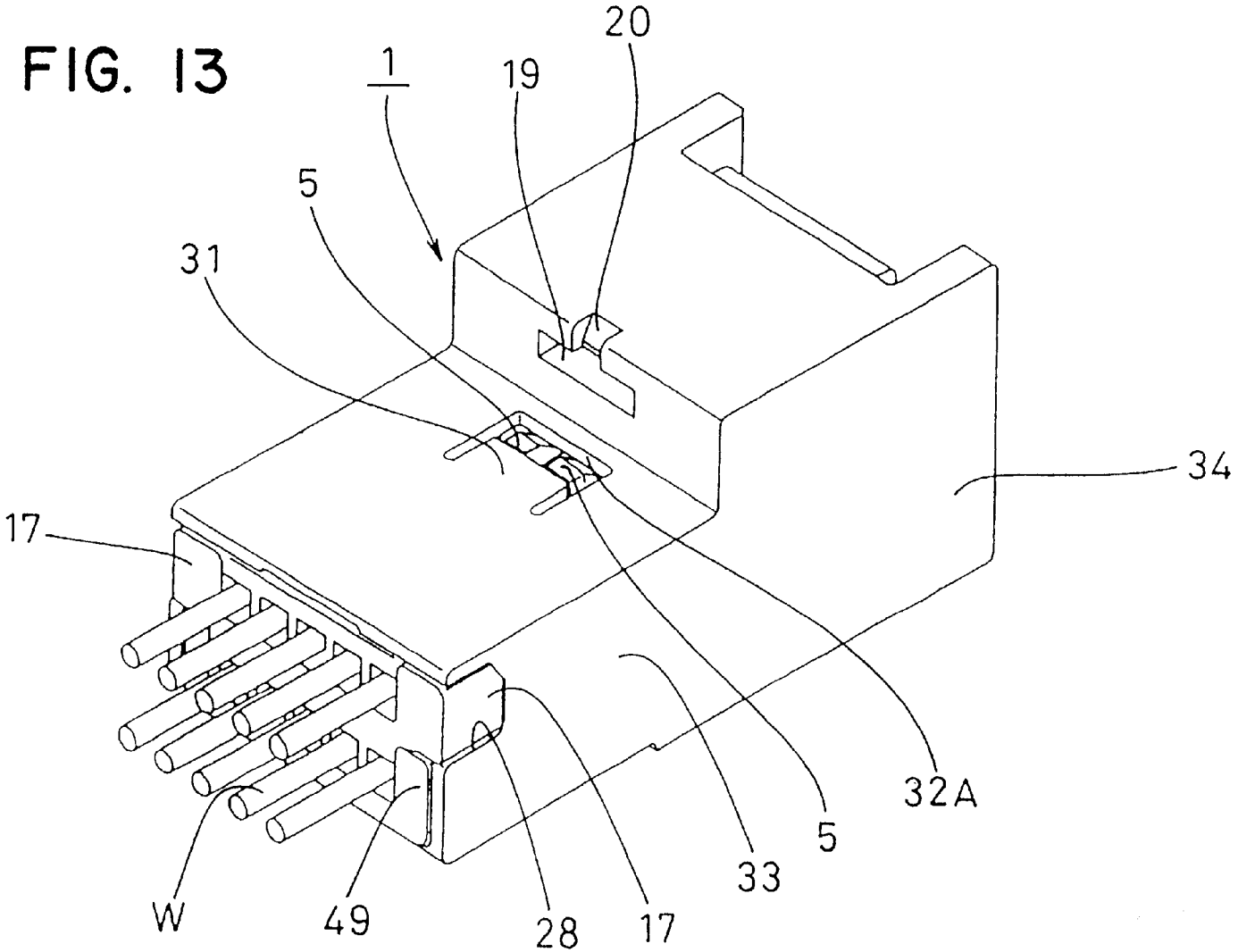
FIG. 13 is a diagonal view of the connector in which the attachment has been completed.
Figure 14:
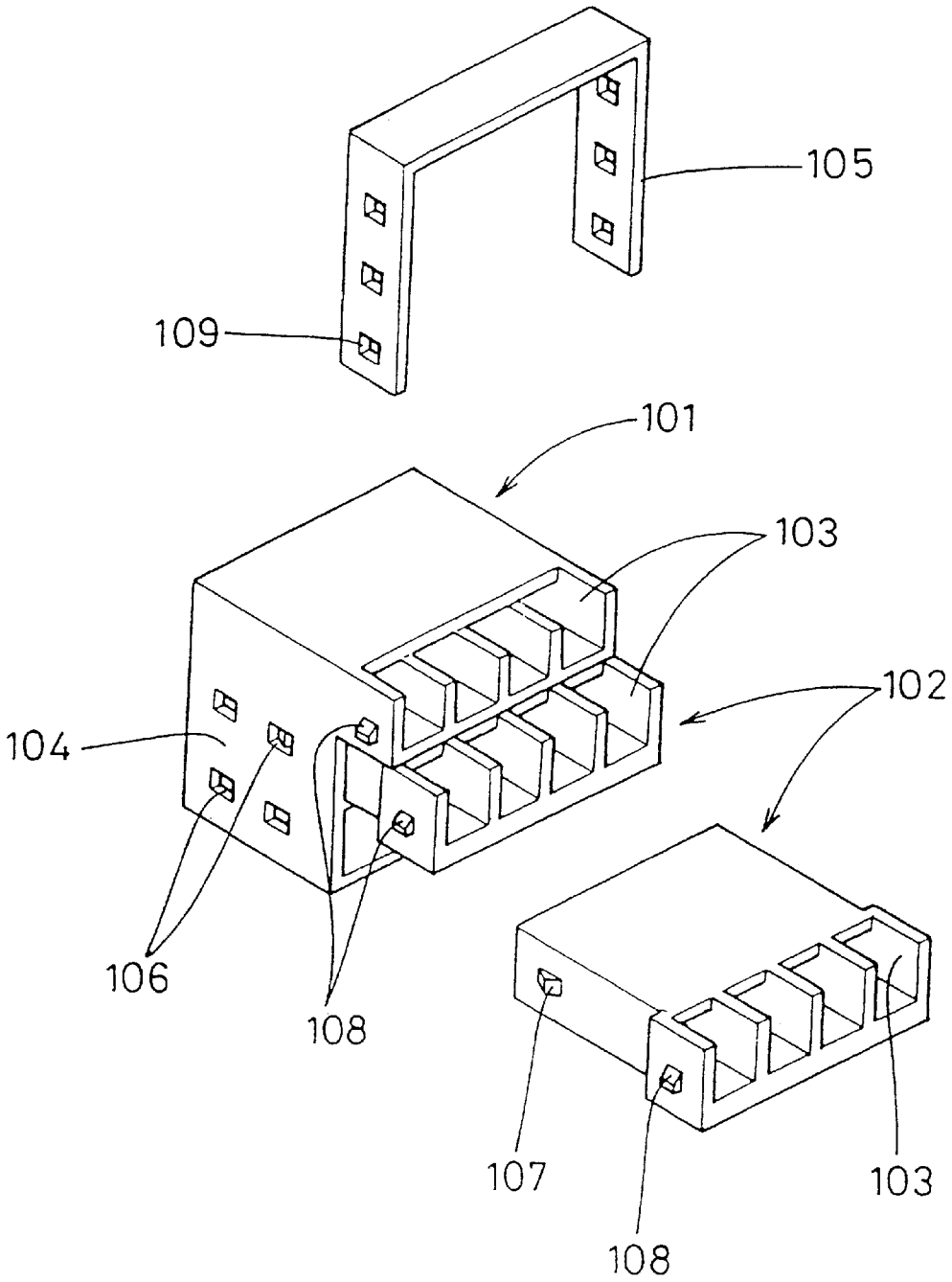
FIG. 14 PRIOR ART
FIG. 14 is a diagonal view of a prior art connector in a separated state.

FIG. 7 shows the upper and lower inner members 7 and 8 in a state prior to being joined together. The cover 46 is pivoted so as to cover the terminal housing chambers 27. The attachment continues with the stopping claws 48 bending the claw receiving members 49 outwards, until the receiving holes 49A fit with the claws 48. The claw receiving members 49 return to their original position, and the attachment of the inner member 8 is complete. The terminal housing chambers 9 of the upper inner member 7 are next placed against the upper face of the lower inner member 8, and both inner members 7 and 8 are pushed together. The dovetailed tenons 14 and 42 fit with the corresponding dovetailed grooves 16 and 43, and the protrusions 17 are bent slightly outwards by the stopping claws 15 until they fit together. In this fitted state, the inner members 7 and 8 form the inner member 3. The upper face of the inner member 3 has a single unified face, whereas the lower face of the inner member 3 has a slight step formed between the cover 46 and the cover 44. That is, as shown in FIGS. 11 and 12, the position of the cover 44 is above that of the cover 46.

Cut-away portions 57 are located on the side edges of all sides of the anterior end face of the inner member 3. These make contact with contact walls 56 provided on the outer member 4.

Next the outer member 4 will be explained with the aid of FIGS. 9 to 12. The outer member 4 is made from plastic in a unified manner and has an angular tubular shape. It houses a corresponding female connector (not shown). The posterior of the outer member 4 is provided with an inner housing chamber 33 that houses the inner member 3. The anterior of the outer member 4 is provided with a hood 34 which is slightly larger than the inner housing chamber 33.

The interior space of the hood 34 is divided into two main sections, the lower section thereof forming a female connector housing space 34A that has approximately the same diameter as the inner housing chamber 33. Above the female connector housing space 34A is a locking space 34B for locking the corresponding female connector (not shown). A locking member 35 is provided on the upper side of this locking space 34B, at the centre of the upper wall of the hood 34. The female connector (not shown) is provided with a locking arm that locks with this locking member 35, the fitting together of this locking arm and the locking member 35 maintaining the two connectors in a connected state. Further, a hole 19 is formed on the upper portion of the posterior face of the hood 34 at the same time that the locking member 35 is formed. A jig guiding groove 20 is formed in a concave manner from the centre of the hole 19 to the upper face of the hood 34. This jig guiding groove 20 is used to guide a jig (not shown) to separate the inner member 3 and the outer member 4. A stopping arm 36 protrudes from the lower face of the hood 34, this stopping arm 36 being bendable in an up-down direction, the tip thereof having a hook-shaped protrusion 36A. This stopping arm 36 serves to fix the pressure contact connector 1 to other members.

The inner housing chamber 33 is slightly larger than the inner member 3, and is formed in an angular tubular shape.

It is thinner than the hood 34. The inner member 3 has a pair of left and right side walls 33A, the posterior of these side walls 33A being cut-into to form a pair of left and right position-fixing grooves 28. These position-fixing grooves 28 are provided on the upper half of the posterior end of each side wall 33A, and are very slightly larger than the position-fixing protrusions 17 of the inner member 3. Furthermore, the portion of the side walls 33A which is below the position-fixing grooves 28 constitutes thin walls 33B, which are thinner than the rest of the side walls 33A. A resilient member 31 is provided in the centre of the anterior portion of an upper wall 30, and is formed by making a C-shaped opening 32, and this resilient member 31 is capable of being bent upwards. The resilient member 31 is slightly wider than the combined width of the stopping protrusions 5. The anterior side of the opening 32 forms a fitting groove 32A, the length from the anterior to the posterior of this fitting groove 32A being slightly longer than the anterior-posterior length of the stopping protrusions 5. The upper wall 30 is thinner, from its posterior end to a posterior end 31A of the resilient member 31, than other wall portions of the inner member 3, and is slightly bendable (see FIG. 11). The upper wall 30 grows gradually thicker from the posterior end 31A of the resilient member 31 to the posterior end of the hood 34, thereby increasing the strength of the upper wall 30. Thick members 55 are provided in an anterior-posterior direction on both sides of the upper wall 30, and are thicker than the rest of the upper wall 30. These thick members 55 form a pair on both outer sides of the resilient member 31, and the outer sides of the thick members 55 are as thin as the rest of the upper wall 30. Consequently, the thick members 55 can easily be bent to the left and right.

The inner housing chamber 33 has a lower wall 29, the posterior portion of which being lower in height than the anterior portion at a location corresponding to the posterior end 31A of the resilient member 31. The portion where the height changes forms a guiding face 29A. In addition, a pair of left and right ribs 54 protrude at the anterior of the lower wall 29, these ribs 54 protruding from a location corresponding to the tip of the resilient member 31 to the end of the inner housing chamber 33. The posterior ends of these ribs 54 have guiding faces 54A. When the inner member 3 is to be housed within the inner housing chamber 33, these ribs 54 push and guide the inner member 3 upwards.

The contact walls 56 are located at the innermost portion of the inner housing member 33, the contact walls 56 protruding inwards from the point where the upper, lower and left and right walls 29, 30 and 33A join with the furthermost inwards portion of the hood 34. These walls 56 make contact with the cut-away portions 57 of the inner member 3 and stop the inner member 3 in an anterior direction.

A prescribed clearance is maintained between the inner member 3 and the upper, lower and left and right walls 33A, 30, and 29 at the opening side of the inner housing chamber 33 of the outer member 4. As the inner member 3 goes deeper into the inner housing chamber 33, the clearance between it and each of the walls 33A, 30, and 29 decreases.

The attachment operation of the inner member 3 has already been explained. This inner member 3 is positioned at the posterior of the outer member 4, and is pushed towards the inner housing chamber 33 (see FIG. 1). The attachment is carried out by the stopping protrusions 5 of the inner member 3 making contact with the posterior end of the inner housing chamber 33, and the guiding faces 5A pushing the upper wall 30 of the inner housing chamber 33 upwards.

The lower face of the inner member 3 has a step formed between the cover 46 and the cover 44 and, consequently as the cover 46 is pushed into the inner housing chamber 33, the upper wall 30 is bent further.

As the inner member 3 is pushed further inwards, the guiding face 29A of the lower wall 29 of the inner housing chamber 33 pushes the cover 44 of the inner member 3 upwards, whereupon the edge of the cover 44 rises over the ribs 54 and the stopping protrusions 5 bend the resilient member 31 further upwards.

Finally, the inner member 3 is pushed into the correct housing position, the stopping protrusions 5 move past the resilient member 31, and the resilient member 31 returns to its original position. In this manner, the stopping protrusions 5 fit with the fitting groove 32A, the resilient member 31 fits with the stopping faces 5B of the stopping protrusions 5, and the inner member 3 and the outer member 4 are latched together. At this juncture, at the anterior end face of the inner member 3, the cut-away members 57 make contact with the contact walls 56, thus fixing the position of the inner member 3 in an anterior direction. Furthermore, at the anterior end portion of the inner housing chamber 33, the position-fixing protrusions 17 fit with the position-fixing grooves 28. In this manner the attachment of the pressure contact connector 1 is completed.

In addition, when the inner member 3 and the inner housing chamber 33 are attached as part of the attachment process described above, the position-fixing protrusions 17 fit with the position-fixing grooves 28 if the inner member 3 and the outer member 4 are attached in the correct position. However, if the inner member 3 is inserted into the inner housing chamber 33 in an upside-down state, this fitting-together will not occur, and as a result it will be apparent that this insertion in incorrect.

In order to separate the stopping protrusions 5 and the resilient member 31, a jig (not shown, but being of a narrow screwdriver shape) is applied to the jig guiding groove 20 of the outer member 4, and the tip of the jig is pushed into the jig insertion groove 18. Then the tip of the jig is levered upwards, and the resilient member 31 is resiliently bent so as to lift up, thereby releasing the stopping protrusions 5. In this state the inner member 3 is removed from the inner housing chamber 33 of the outer member 4. The width of the position-fixing protrusion 17 is the same as or slightly shorter than that of the outer member 4 and, consequently, when the pressure contact connector 1 is in the completely attached state, the position-fixing protrusions 17 can be pinched from the outer side of the inner housing chamber 33. In this manner, when the inner member 3 and the outer member 4 of the pressure contact connector 1 are to be separated, both position-fixing protrusions 17 are pinched from the outside, and the inner member 3 and the outer member 4 can be pulled apart.

According to the present embodiment, when the inner member 3 and the outer member 4 are being attached, the fitting together of the position-fixing protrusions 17 fit with the position-fixing grooves 28 prevents this insertion from being performed incorrectly.

Further, the position-fixing protrusions 17 perform a second function of acting as a joining means for the inner members 7 and 8. As a result, there is no need to provide the position-fixing protrusions 17 and the joining means separately, and the configuration is therefore simpler.

Moreover, the position-fixing protrusions 17 are formed so as not to protrude beyond the side walls of the outer member 4. As a result, when the pressure contact connector 1 is in a joined state the position-fixing protrusions 17 do not protrude outwards and cannot become entangled with other members, etc.

The present invention is not limited to the embodiments described above. For example, the possibilities described below also lie within the technical range of the present invention.

(1) In the present embodiment only male terminal fittings are shown. However, according to the present invention, a female connector can be used to house female terminal fittings.

(2) The terminal housing chamber may be of more than two layers.

What is claimed is:

1. A pressure contact electrical connector comprising a tubular outer housing, and an inner housing insertable into said outer housing, said inner housing comprising a first inner body and a second inner body each adapted to contain pressure contact terminal fittings, wherein the inner housing has protrusions on opposite sides thereof, the protrusions each having a latch member to latch the first and second inner bodies together, and wherein the outer housing has opposite recesses to receive said protrusions in only one orientation of said outer housing and said inner housing.

2. A connector according to claim 1 wherein said protrusions protrude to the exterior of said outer housing, and are adapted to be pinched to permit removal of said inner housing from said outer housing.

3. A connector according to claim 2 wherein said protrusions extend upwardly and laterally from an upper face of said inner housing.

4. A connector according to claim 1 wherein resilient latch members of one of the inner bodies are engageable in corresponding recesses of said protrusions on another of the inner bodies to latch the two bodies together.

5. A connector according to claim 1 wherein said inner housing includes a projection on an outer face thereof for latching engagement in a recess of said outer housing.

6. A connector according to claim 5 wherein the wall thickness of said outer housing is reduced in the direction of insertion from the mouth thereof to said recess.

7. A connector according to claim 5 wherein said projection defines a channel passed therethrough in the insertion direction of said inner housing, and said recess comprises an aperture in the wall of said outer housing, said aperture having slits extending in the direction of withdrawal of said inner housing to define a tongue engageable against said projection, in use a tool in said channel being adapted to lift said tongue to permit said inner housing to be withdrawn.

8. A connector according to claim 6 wherein said projection defines a channel passed therethrough in the insertion direction of said inner housing, and said recess comprises an aperture in the wall of said outer housing, said aperture having slits extending in the direction of withdrawal of said inner housing to define a tongue engageable against said projection, in use a tool in said channel being adapted to lift said tongue to permit said inner housing to be withdrawn.

9. A connector according to claim 7 wherein said outer housing defines a groove aligned with said channel and adapted to support a release tool.

10. A connector according to claim 8 wherein said outer housing defines a groove aligned with said channel and adapted to support a release tool.

11. A connector according to claim 1 wherein said outer housing includes an internal projection to limit insertion of said inner housing.

12. A connector according to claim 1 wherein said inner housing is received in said outer housing with a peripheral clearance, said clearance reducing from the mouth of said outer housing.

13. A pressure contact electrical connector comprising a tubular outer housing, and an inner housing insertable into said outer housing, the inner housing including an inner body containing pressure contact terminal fittings, a pivotal cover latchable to the inner body in a closed position over wire engaging portions of the terminal fittings, and protrusions on opposite sides thereof, and wherein the outer housing includes opposite recesses to receive the protrusions in only one orientation of said outer housing and said inner housing.

14. A connector according to claim 13 wherein the inner housing includes a second inner body containing contact terminal fittings which is latchable to the first inner body.

15. A connector according to claim 14 wherein the protrusions each include latch members to latch the two inner bodies together.

* * * * *